US009844733B1

(12) United States Patent
Veira

(10) Patent No.: US 9,844,733 B1
(45) Date of Patent: Dec. 19, 2017

(54) INTERACTIVE TOY BIN

(71) Applicant: Bianca Veira, St. Cloud, FL (US)

(72) Inventor: Bianca Veira, St. Cloud, FL (US)

( * ) Notice: Subject to any disclaimer, the term of this patent is extended or adjusted under 35 U.S.C. 154(b) by 0 days.

(21) Appl. No.: 15/356,851

(22) Filed: Nov. 21, 2016

(51) Int. Cl.
*A63H 3/00* (2006.01)
*A63H 3/28* (2006.01)
*B65D 81/36* (2006.01)

(52) U.S. Cl.
CPC ..... *A63H 3/005* (2013.01); *A63H 3/006* (2013.01); *A63H 3/28* (2013.01); *B65D 81/365* (2013.01); *A63H 2200/00* (2013.01)

(58) Field of Classification Search
CPC ..... A63H 3/005; A63H 3/28; A63H 33/00; A63H 13/00; B65D 81/365
USPC ..... 446/73, 75, 76, 270; 206/457
See application file for complete search history.

(56) References Cited

U.S. PATENT DOCUMENTS 3,081,084 A * 3/1963 Glass ..... A63H 33/00 446/405
4,103,455 A * 8/1978 Silvey ..... A63H 3/005 446/270
4,200,197 A * 4/1980 Meyer ..... A63H 33/00 220/263
4,736,847 A * 4/1988 Wang ..... A63H 3/005 206/457
5,458,521 A * 10/1995 Todd ..... A63H 3/005 229/116.3
5,674,103 A * 10/1997 Bean ..... A63H 33/04 206/457
5,702,003 A * 12/1997 Springer ..... A47B 81/00 206/457
5,984,098 A * 11/1999 Cahen ..... A63H 33/00 206/457
6,687,927 B1 * 2/2004 Tharalson ..... A47D 13/06 220/495.01
6,707,777 B1 * 3/2004 Cherry ..... A63H 5/00 369/63
8,157,094 B2 * 4/2012 Schiessl ..... B65D 21/0212 206/457
8,926,394 B1 * 1/2015 Strong ..... A63H 3/48 224/153
2010/0155269 A1 * 6/2010 Sosalla ..... B65D 79/00 206/216
2011/0053452 A1 * 3/2011 Akkad ..... A63H 3/005 446/73
2011/0272370 A1 * 11/2011 McDonald ..... A47F 3/00 211/85.7
2015/0174499 A1 * 6/2015 Rosenheck ..... A63H 3/005 434/118
2017/0216733 A1 * 8/2017 Williams ..... A63H 3/005

* cited by examiner

*Primary Examiner* — Alexander Niconovich
(74) *Attorney, Agent, or Firm* — Jason T. Daniel, Esq.; Daniel Law Offices, P.A.

(57) ABSTRACT

An interactive toy bin includes a receptacle having an open top end, a middle section and a closed bottom end defining a generally hollow cavity for receiving toys. A motion sensor is positioned along the periphery of the open top end, and a plurality of lights are disposed along the outside portion of the receptacle. A stylized main body character having a speaker, a control system and a rotational actuator is positioned along the outside portion of the receptacle.

12 Claims, 3 Drawing Sheets

INTERACTIVE TOY BIN

TECHNICAL FIELD

The present invention relates generally to storage devices, and more particularly to an interactive toy bin.

BACKGROUND

The statements in this section merely provide background information related to the present disclosure and may not constitute prior art.

As any parent will attest, getting children to clean their room can be one of life's most difficult tasks. Whether it is clothes on the floor, or toys scattered everywhere, it can be difficult to persuade children to place such items in the proper location.

Although there are many types of toy bins and hampers that are commercially available, such items are typically constructed with a function-over-form approach. As such, these toy bins do not possess anything that would be perceived as fun or even welcoming to a small child, and therefore do nothing to encourage children to place their toys within the bin. Accordingly, it would be beneficial to provide a toy bin that can provide a fun and interactive experience for a child, so as to encourage the child to deposit toys into the bin.

The present invention, directed to an interactive toy bin differs from the conventional art in a number of aspects. The manner by which will become more apparent in the description which follows, particularly when read in conjunction with the accompanying drawings.

SUMMARY OF THE INVENTION

The present invention is directed to an interactive toy bin. One embodiment of the present invention can include a receptacle having an open top end, a middle section and a closed bottom end defining a generally hollow cavity for receiving toys. A motion sensor can be positioned along the periphery of the open top end and can function to identify when a toy is being deposited within the receptacle. A plurality of lights can be disposed along the outside portion of the receptacle and can be selectively activated by the motion sensor.

Another embodiment of the present invention can include a stylized main body character that is positioned along the outside portion of the receptacle. The stylized character can include a stuffed animal having a plurality of legs, a neck, and a moveable head.

Yet another embodiment of the present invention can include a rotational actuator which can mechanically sway the head back and forth. The device can also include a system controller for controlling the operation of the electrical components of the device.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

As described throughout this document, the term "decorative elements" can include any number and type of different colors, markings, words, shapes, symbols, logos, designs, types of materials, texturing of materials, patterns, images, lithographs, photographs and/or jewels, for example. These elements can be secured onto and/or into the identified portion of the device main body in accordance with known techniques so as to be flush with the surface thereof or can be recessed, raised and/or protruding outward therefrom, so as to give a three dimensional effect.

Figure 1:
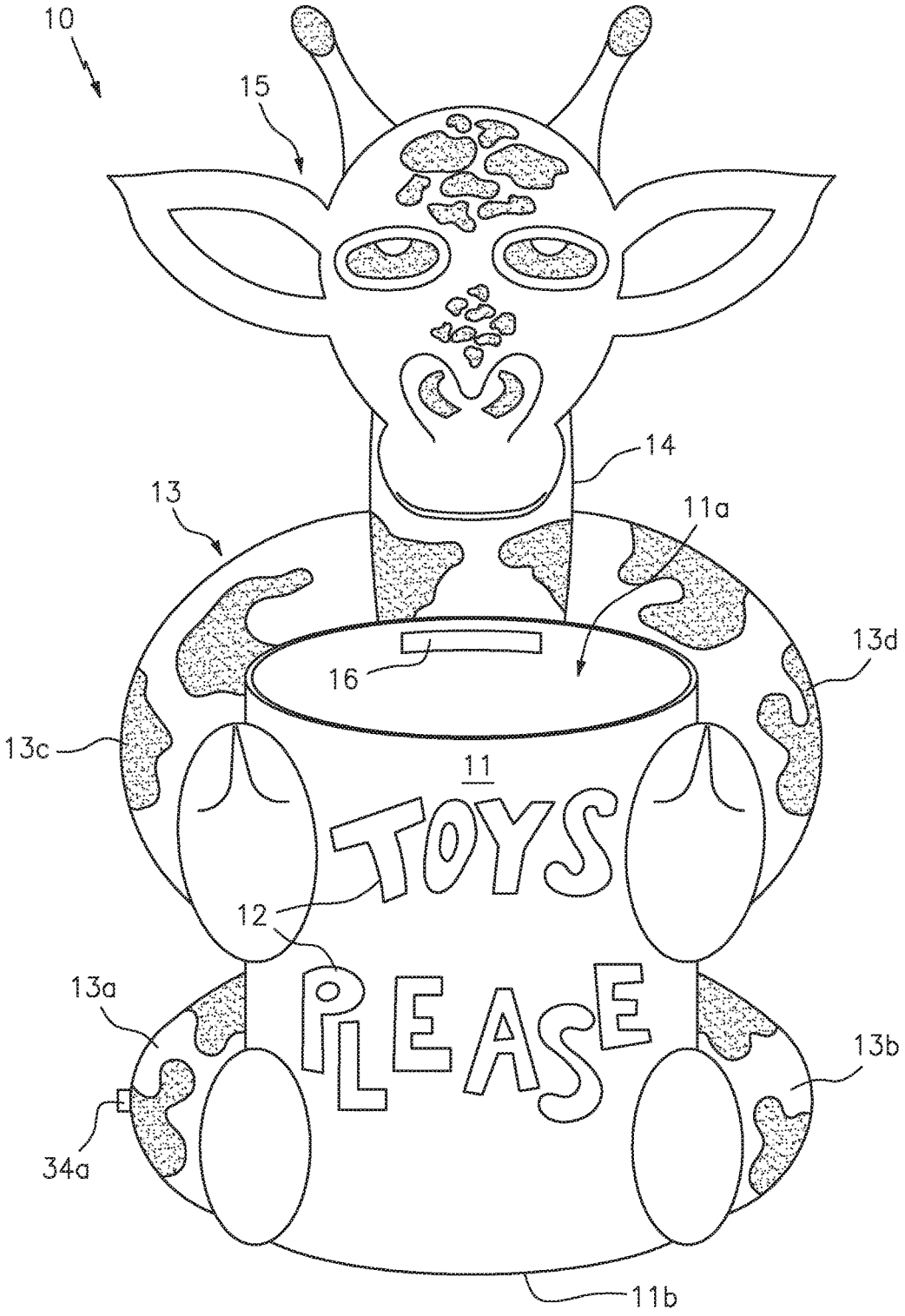
FIG. 1 is a front view of the interactive toy bin that is useful for understanding the inventive concepts disclosed herein.
Figure 2:
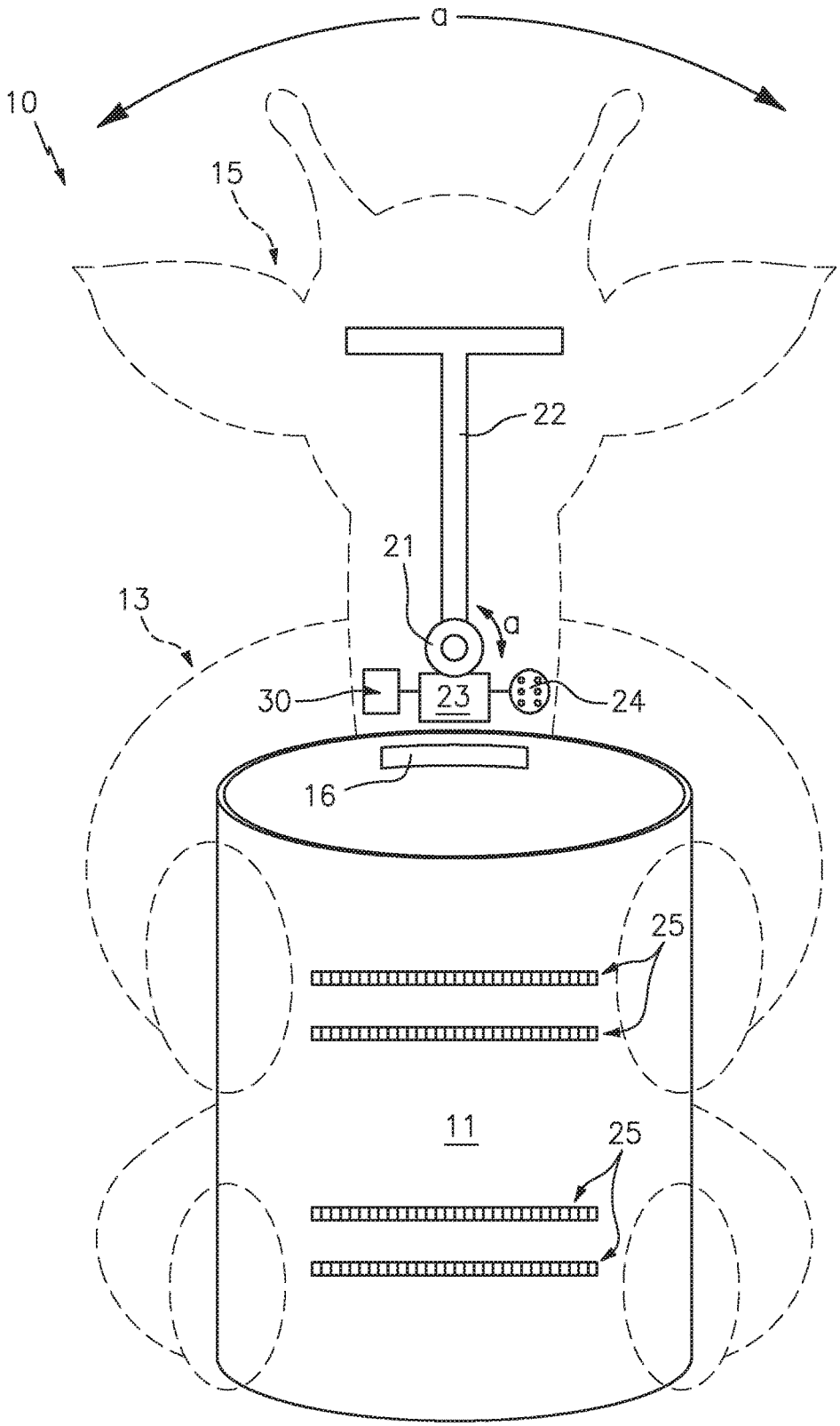
FIG. 2 depicts an internal view of the interactive toy bin, in accordance with one embodiment of the invention.
Figure 3:
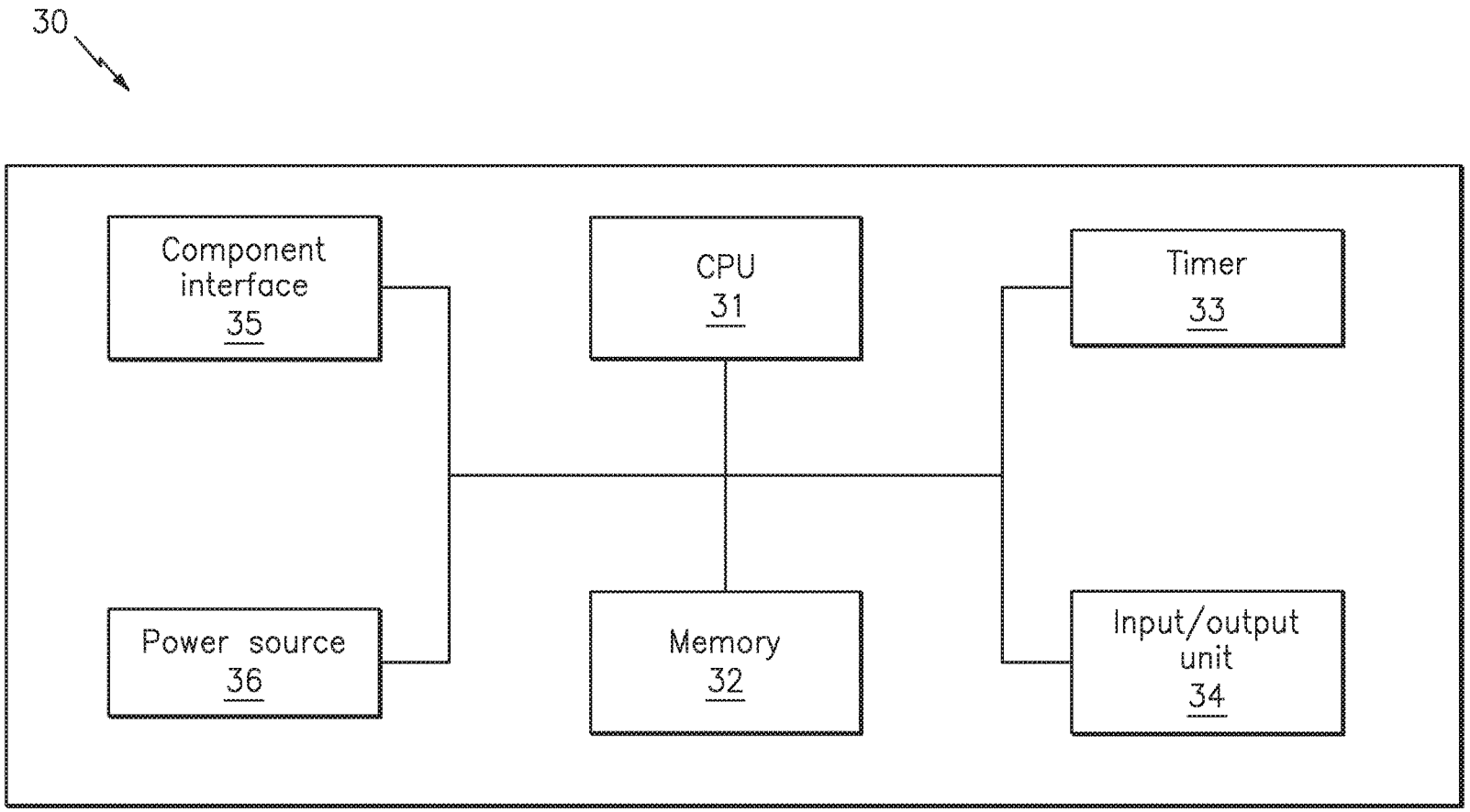
FIG. 3 is a simplified block diagram of the internal system controller of the interactive toy bin, in accordance with one embodiment of the invention.

FIGS. 1-3 illustrate various embodiments of an interactive toy bin 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure.

For purposes of this description, the tennis "upper," "bottom," "right," "left," "front," "vertical," "horizontal," and derivatives thereof shall relate to the invention as oriented in FIG. 1, which is a front of the device 10 that includes a receptacle 11, and a main body 13 in the form of a stylized character that is holding onto the receptacle.

As shown, the receptacle 11 can include an open top end 11*a*, a capped bottom end 11*b* and a continuous middle section forming a cavity for receiving toys, clothes and other such items. In the preferred embodiment, the receptacle can include the illustrated cylindrical shape, can be constructed from plastic, and can be adorned with any number of decorative elements 12 along the outside facing surfaces thereof. Such decorative elements can also be disposed along any portion of the main body. Of course, the receptacle can be constructed from any number of other materials and can include any number of different shapes and sizes.

In the illustrated embodiment, the stylized main body character 13 can take the form of a giraffe having a pair of bottom legs 13*a* and 13*b*, a pair of top legs 13*c* and 13*d*, a neck section 14 and a moveable head 15.

The main body can preferably be constructed from a soft outer material such as synthetic fur, for example, and the legs 13*a*-13*d* can be stuffed with any type of soft, plush material such as 100% hi-loft polyester and/or foam, for example. In the preferred embodiment, each of the legs 13*a*-13*d* can be permanently secured along the outside portion of the receptacle via an adhesive or other such means, so as to maintain the illusion that the character is holding the receptacle 11.

In various embodiments, the device can include one or more sensors 16, which can function to determine the presence of an object such as a toy or piece of clothing, for example, being deposited into the receptacle. In the preferred embodiment, the sensor 16 can include or comprise one or more photoelectric motion sensors, for example, that are positioned along and/or within the open top end 11*a* of the receptacle. Of course, any number of other devices capable of sensing the presence of an object within the sensing area are also contemplated.

Although described above as including specific materials and a giraffe-shaped stylized character this is for illustrative purposes only. To this end, those of skill in the art will recognize that the stylized main body character can be formed to include any number of different shapes and designs which can represent and/or resemble anything such as an animal, a cartoon or movie character, a person, an alien, and/or objects such as a spaceship, car, boat or plane, for example. Moreover, the stylized main body character can be constructed from any number of different materials, can include any number of sizes, and can be secured to the receptacle in any number of different poses.

As shown in FIG. 2, the device 10 can also include a head actuation unit, and a control system 30 for performing various interactive activities. In the preferred embodiment, the actuation unit can function to provide movement of the head 15, and can include a rotation servo 21 having an elongated, generally rigid shaft 22 extending upward therefrom. The rotation servo can be connected to a bracket 23 that is secured along the back and/or top portion of the receptacle 11. In this regard, the rotation servo can function to swing the shaft 22 back and forth in a generally inverted pendulum motion, thereby causing the entire head 15 to sway back and forth, as shown by arrows a.

Although described as including a rotation servo and elongated shaft to impart motion onto the head of the device, this is for illustrative purposes only. As such, any number of other electrical and/or mechanical components capable of performing this motion are also contemplated.

In various embodiments, the device 10 can also include any number of speakers 24 and/or lighted elements 25, which can be disposed along or within any portion of the main body 13 and/or the receptacle 11. To this end, the speaker 24 can function to play any number of sounds such as various music, words or songs, for example, upon being activated by the control system. In the preferred embodiment, each of the one lighted elements 25 can include or comprise light emitting diodes (LED), for example. Each of the lighted elements can include any number of different colors, and can function to flash, or remain illuminated, based on an instruction from the control system. To this end, the lighted elements can function to backlight the decorative elements, and/or to be clearly visible along an outside facing surface of the device.

The control system 30 can function to communicate with a device user and can control the operation of the device itself. As shown in FIG. 3, one embodiment of the system controller can include a processor 31 that is conventionally connected to an internal memory 32, a timer module 33, an input/output unit 34, an internal component interface unit 35, and/or a power source 36.

Although illustrated as separate elements, those of skill in the art will recognize that one or more system components may comprise, or include one or more printed circuit boards (PCB) containing any number of integrated circuit or circuits for completing the activities described herein. The CPU may be one or more integrated circuits having firmware for causing the circuitry to complete the activities described herein. Of course, any number of other analog and/or digital components capable of performing the below described functionality can be provided in place of; or in conjunction with the below described controller elements.

The processor/CPU 31 can act to execute program code stored in the memory 32 in order to allow the device to perform the functionality described herein. Likewise, a timer module 33 can be provided, and can function to accurately measure the passage of time. As described herein, the tinier module can be provided as a function of the processor or can include a separate physical circuit. In either instance, processors and timers are extremely well known the art, therefore no further description will be provided.

Memory 32 can act to store operating instructions in the form of program code for the processor 31 to execute. Although illustrated in FIG. 3 as a single component, memory 32 can include one or more physical memory devices such as, for example, local memory and/or one or more bulk storage devices. As used herein, local memory can refer to random access memory or other non-persistent memory device(s) generally used during actual execution of program code, whereas a bulk storage device can be implemented as a persistent data storage device such as a hard drive, for example. Additionally, memory 32 can also include one or more cache memories that provide temporary storage of at least some program code in order to reduce the number of times program code must be retrieved from the bulk storage device during execution. Each of these devices are well known in the art.

The input/output unit 34 can act to accept user inputs and provide instructions to the processor. In one preferred embodiment, the input/output unit can include or comprise one or more buttons 34*a*, for example, that are connected to the processor 31 so as to activate different programmatic functions. For example, the push button can act to initiate programming for instructing the processor 31 to switch the electronic components of the device between an ON and OFF state, initiate a Sleep mode, and/or to individually activate one or more of the speaker, lights and/or actuation unit, for example.

The internal component interface unit 35 can function to provide a communicative link between the processor 31 and various other device components such as the sensor 16, speaker 24 and/or lights 25, for example. In this regard, the component interface unit can include any number of different components such as one or more PIC microcontrollers, internal bus, USB connections and other such hardware capable of providing a direct link between the various components. Of course any other means for providing the two way communication between the identified components can also be utilized herein.

The power source 36 can include any number of different components capable of providing the necessary power requirements to each element of the locator unit. To this end, the power source can include or comprise any number of different batteries and/or can include a common A/C electrical power transformer and cord capable of allowing the locator unit to be powered from an electrical outlet.

In operation, the interactive toy bin 10 can provide a fun and interactive way to encourage children to deposit items such as toys and clothes within the receptacle. In this regard, when the system is in the ON operating position, the sensor 16 can function to detect the presence of an object being deposited within the receptacle.

Upon detection of the object, the sensor 16 can notify the processor 31 which can then retrieve any number of interactive commands stored within the memory 32. For example, one such command can instruct the processor to activate the lights 25, play a song stored within the memory 31 on the speaker 24 and/or activate the rotation servo 21 to sway the head 15 of the stylized main body back and forth in rhythm to the song. Such activities can last for any length of time as determined by the timer. Of course, any number of other interactive gestures can also be performed utilizing each of the above noted components alone or in any combination.

As described herein, one or more elements of the interactive toy bin 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individual elements such as the main body 13 and/or the receptacle 11, along with any number of subcomponents may be formed together as one continuous element, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. An interactive toy bin device, comprising:

a receptacle having an open top end, a middle section and a closed bottom end defining a generally hollow cavity;

a sensor that is positioned within the generally hollow cavity of the receptacle, and being configured to detect passage of an object into the receptacle;

a stylized main body character that is positioned along an outside portion of the receptacle, said character including a plurality of legs, a neck, and a moveable head;

a head actuation unit that is positioned within the stylized main body character; and a control system that is in communication with the sensor and the head actuation unit, wherein the control system includes functionality for selectively activating the head actuation unit upon receiving a notification from the sensor that an object has been placed into the receptacle.

2. The device of claim 1, wherein the control system is positioned within the stylized main body, and includes a processor and a memory.

3. The device of claim 2, further comprising:

a speaker that is positioned within the stylized main body character.

4. The device of claim 3, wherein the speaker is in communication with the control system, and is selectively operated upon activation of the motion sensor.

5. The device of claim 4, wherein the memory is loaded with at least one song for playback by the speaker.

6. The device of claim 1, further comprising:

one or more lighted elements that are disposed along one of the receptacle and the stylized main body character.

7. The device of claim 6, wherein each of the one or more lighted elements are in communication with the control system, and are selectively operated upon activation of the motion sensor.

8. The device of claim 1, wherein the sensor comprises:

a motion sensor that is positioned adjacent to the open top end of the receptacle, and having a sensor area that is limited to the hollow cavity of the receptacle.

9. The device of claim 1, wherein the sensor consists of:

a motion sensor that is positioned adjacent to the open top end of the receptacle, and having a sensor area that is limited to the hollow cavity of the receptacle.

10. The device of claim 1, wherein the head actuation unit comprises:

a rotation servo that is physically coupled to the receptacle; and an elongated rigid shaft that is physically coupled to the rotation servo, wherein the rotation servo is configured to selectively swing the elongated shaft in an inverted pendulum motion.

11. The device of claim 10, wherein the elongated rigid shaft includes a first end that is secured to the rotation servo, and a broad second end that is positioned within the moveable head.

12. The device of claim 1, wherein the head actuation unit consists of:

a rotation servo that is physically coupled to the receptacle; and an elongated rigid shaft that is physically coupled to the rotation servo, wherein the rotation servo is configured to selectively swing the elongated shaft in an inverted pendulum motion.

* * * * *